US006729210B2

(12) United States Patent
Morris

(10) Patent No.: US 6,729,210 B2
(45) Date of Patent: May 4, 2004

(54) DRIVER FOR EYEBOLTS AND HOOKS

(76) Inventor: John L. Morris, 1439 63rd St., Des Moines, IA (US) 50311

( * ) Notice: Subject to any disclaimer, the term of this patent is extended or adjusted under 35 U.S.C. 154(b) by 633 days.

(21) Appl. No.: 09/894,738

(22) Filed: Jun. 28, 2001

(65) Prior Publication Data

US 2003/0000349 A1 Jan. 2, 2003

(51) Int. Cl.[7] ..... B25B 13/02
(52) U.S. Cl. ..... 81/124.2; 81/125; 81/901
(58) Field of Search ..... 81/121.1, 125, 81/124.2, 901, 487

(56) References Cited

U.S. PATENT DOCUMENTS

| | | | | |
|---|---|---|---|---|
| 841,472 | A | | 1/1907 | Vanderherchen |
| 985,087 | A | | 2/1911 | Wilson |
| 2,231,323 | A | | 2/1941 | Cawood |
| 2,642,105 | A | | 6/1953 | Alliano |
| 3,086,414 | A | | 4/1963 | Nardi |
| 3,148,890 | A | * | 9/1964 | Mitchell ..... 81/121.1 |
| D274,881 | S | | 7/1984 | Wilsey |
| 4,724,731 | A | | 2/1988 | Onofrio |
| D298,730 | S | | 11/1988 | Zinn |
| 5,058,465 | A | * | 10/1991 | Womack ..... 81/487 |
| 5,123,310 | A | * | 6/1992 | McManus ..... 81/125 |
| 5,335,569 | A | | 8/1994 | Rowley |
| D379,420 | S | | 5/1997 | Standlee et al. |
| 5,697,268 | A | | 12/1997 | Makovsky et al. |
| 5,746,416 | A | * | 5/1998 | Paylor ..... 81/124.2 |
| 5,791,208 | A | | 8/1998 | Grubbs |
| 5,943,922 | A | | 8/1999 | Rolfe |

* cited by examiner

*Primary Examiner*—James G. Smith
(74) *Attorney, Agent, or Firm*—McKee, Voorhees & Sease, P.L.C.

(57) ABSTRACT

A driver for eyebolts and hooks includes a body with a driver head bifurcated by a longitudinal slot to form a pair of side walls and a bottom wall. A hole through one of the side walls intersects the slot. A set screw installed in the hole releasably engages and secures the eyebolt in the slot.

5 Claims, 3 Drawing Sheets

DRIVER FOR EYEBOLTS AND HOOKS

BACKGROUND OF THE INVENTION

The present invention relates to the field of driving devices for installing or removing specialized fasteners, such as eyebolts, hooks and the like.

Eyebolts and hooks are convenient ways to hang things in a garage or barn. However, installing eyebolts and hooks in such locations can be tiring, time-consuming and difficult. Recently AC or battery powered drills have been tried for installing the eyebolts or hooks. Various adapters are known for installing or removing eyebolts with drills. However, these devices are generally dedicated to one particular type or size of eyebolt or hook and are not very versatile. Moreover, many of these devices are elaborate and time-consuming to assemble and attach to the eyebolt or hook. Thus, there is a need for a simple yet effective device for installing and removing eyebolts or hooks.

Therefore, a primary objective of the present invention is a provision of a device for installing and removing eyebolts or hooks that is reliable, effective in use, easy to use and inexpensive to make.

Another objective of this invention is a provision of a device for installing and removing eyebolts or hooks that is versatile enough to accommodate various types and sizes of eyebolts and hooks.

Another objective of the present invention is a provision of a device for installing and removing eyebolts or hooks that is adapted to be driven by a cordless or AC powered variable speed hand drill.

These and other objectives will be apparent from the drawings, as well as from the description and claims that follow.

SUMMARY OF THE INVENTION

The present invention relates to a device for driving specialized fasteners such as eyebolts, hooks and the like. The driver has a body that includes an elongated driver head with opposite forward and rear ends and a central axis of rotation extending through the ends. The body has means thereon for detachably connecting the driver head to a source of rotary power, for example a drill.

The head has a centrally located longitudinal slot of a fixed width and depth bifurcating its forward end so as to form a pair of opposing side walls and a bottom wall. The driver has a threaded hole extending through one of the side walls so as to intersect the slot at a location near the bottom wall. A set screw matingly installs in the threaded hole. The threaded hole and set screw are sized and arranged so that the set screw releasably engages an upper quadrant of the eyebolt rod that rests on the bottom wall. Thus, the set screw provides a clamping force directed toward both the bottom wall and the other side wall so as to effectively secure the eyebolt or hook in the slot. The slot preferably extends completely across the forward end of the driver head so the fastener to be driven can be inserted from the side or the end of the head.

An optional counterbore in the forward end of the driver head can be used for clearance and location purposes when driving certain U-shaped hooks.

Also shown with phantom lines alongside the driver is a nonexhaustive sample of other types of specialized fasteners, such as eyebolts and hooks, which the driver is adapted to receive and drive.

Figure 1:
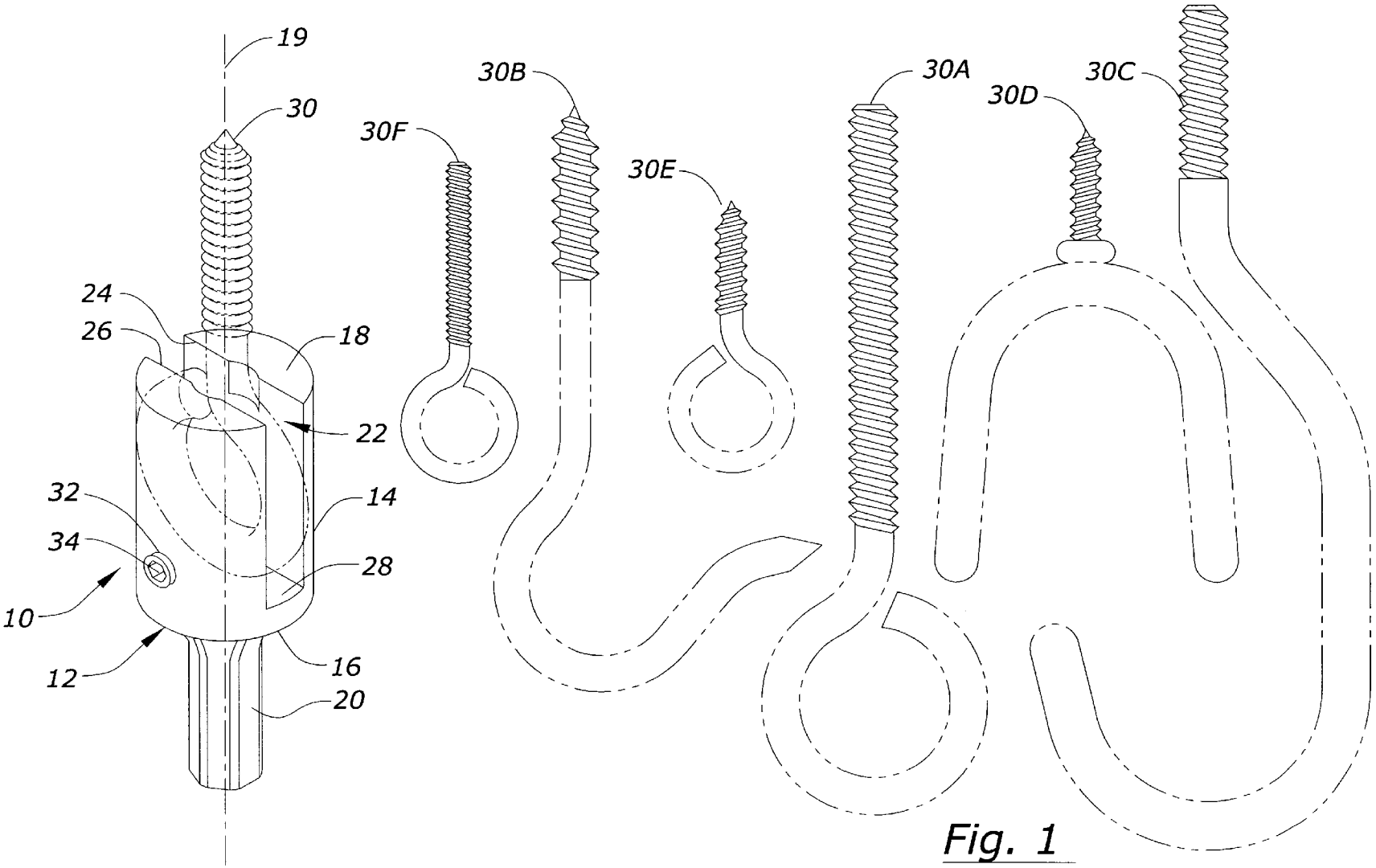
FIG. 1 is a perspective view of the driver of the present invention with a fastener inserted and ready to be driven.
Figure 2:
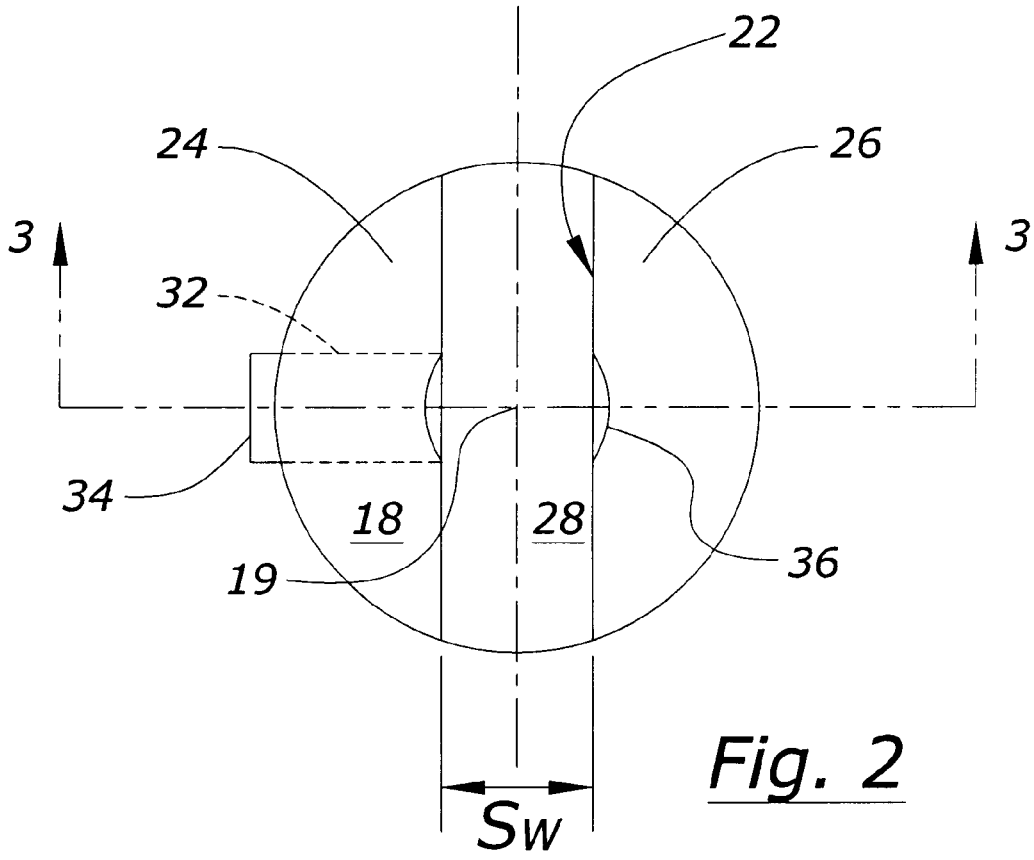

FIG. 2 is a top plan view of the driver of FIG. 1.

Figure 3:
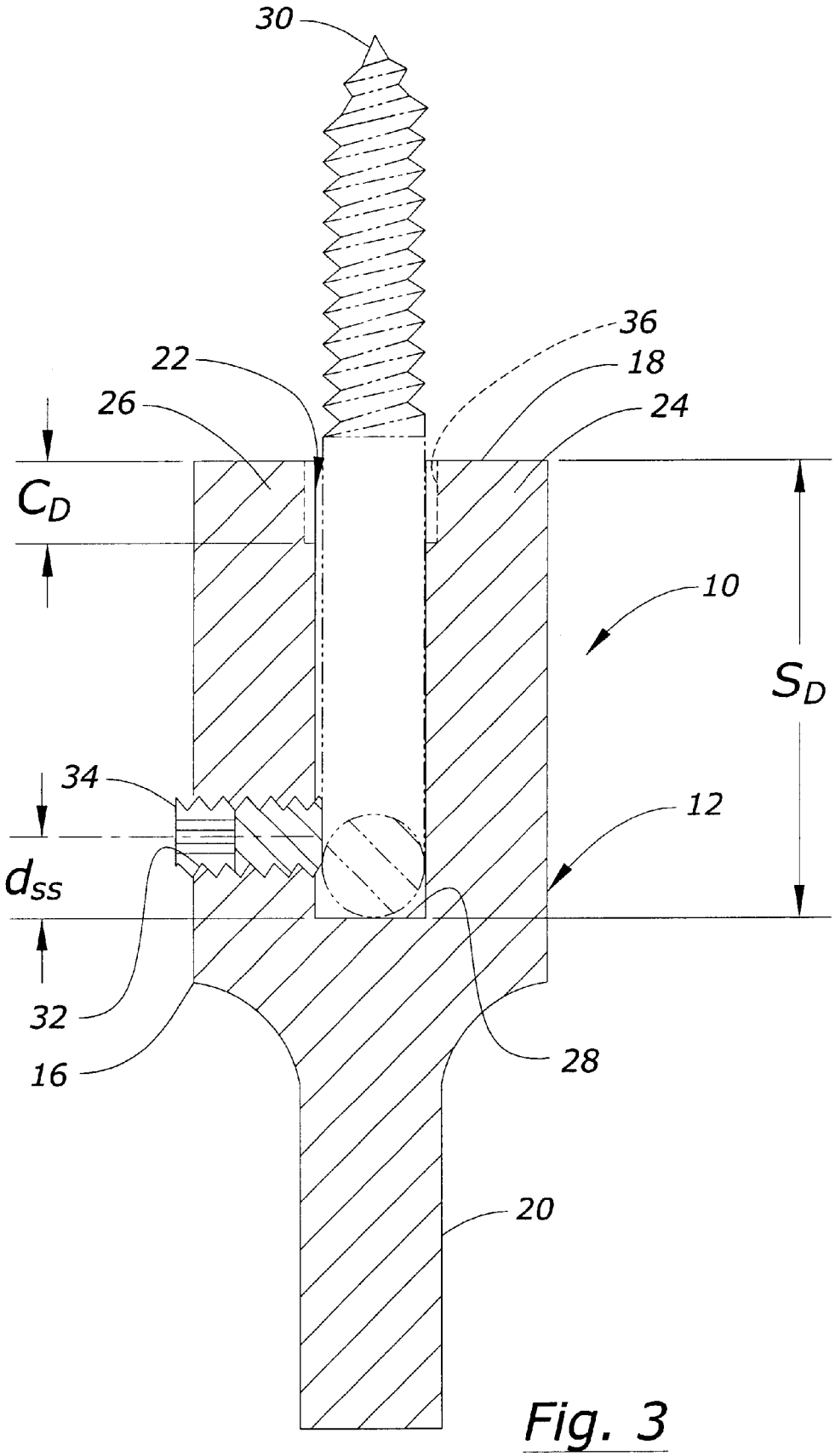

FIG. 3 is a cross sectional view of the driver and fastener therein taken along line 3—3 in FIG. 2.

DETAILED DESCRIPTION OF THE INVENTION

The device of the present invention is generally designated in FIGS. 1–3 by the reference numeral 10. The device is essentially a driver for installing and removing specialized fasteners such as eyebolts, hooks, and the like. The device or driver 10 includes a rigid body 12 of steel or other suitably strong material with an elongated driver head 14 having opposite forward and rear ends 16, 18, and a central axis of rotation 19 extending through the ends. The driver head 14 is preferably cylindrically shaped; however, other shapes are possible so long as they are suitably balanced for rotation about the axis of rotation 19. The body 12 also has means 20 thereon for detachably connecting the driver head 14 to a conventional source of rotary power, such as an AC or cordless drill. Preferably the drill is a variable speed drill with a chuck capable of accepting drill bits with shanks up to ½ inch in diameter.

The means 20 for connecting the driver head 14 to the drill is preferably in the form of a shank connected to the rearward end 18 of the driver head 14. Preferably the shank has a hexagonal cross section. However, other means of connecting the driver head 14 to the drill are contemplated to be within the scope of this invention, including but not limited to, a female socket of hexagonal or other suitable shape.

The driver head 14 has a single centrally located longitudinal slot 22 of a fixed width $S_W$ and depth $S_D$ bifurcating the forward end 16 of the driver head 14 so as to form a pair of opposing side walls 24, 26 and a bottom wall 28. In other words, the slot 22 extends across the forward end 16 and along the central axis of rotation 19 towards the rear end 18. Although not an absolute requirement, it is preferred that the slot 22 extends completely across the forward end 16 of the driver head 14. The side walls 24, 26 and the bottom wall 28 are preferably planar. The slot 22 has a rectangular shape. Thus, the slot 22 is adapted to slidably receive a portion of a fastener, such as an eyebolt 30 or another similar member. The width $S_W$ of the slot 22 should be slightly larger than the diameter of the cylindrical rod that forms the nonthreaded portion of the eyebolt 30. The depth $S_D$ of the slot 22 is selected so as to be at least as great as the diameter of the eyebolt rod.

The driver head 14 has a threaded hole 32 extending through one of the side walls 26 and a set screw 34 matingly installs into the threaded hole 32 to selectively protrude into the slot 22. Although the hole 32 could be angled or inclined without detracting from the invention, the hole 32 is preferably perpendicular to the axis or rotation 19 for ease of machining. The hole 32 intersects the slot 22 at a location near the bottom wall 28. Preferably, the centerline of the hole 32 is spaced forwardly or upwardly from the bottom wall 28 by a distance $d_{SS}$. The necessary distance $d_{SS}$ can easily be determined based upon the size of the hole 32, the size of the set screw 34, and the diameter of the rod that forms the eyebolt eye and rests on the bottom wall 28. The goal is to have the set screw 34 engage an upper quadrant of the eyebolt rod, as best seen in FIG. 3. Such engagement provides a clamping force directed toward both the bottom wall 28 and the other side wall 24 so as to effectively secure the eyebolt 30 or hook in the slot 22.

In use, the user loosens the set screw 34 so that it does not protrude into the slot 22. Then the nonthreaded portion of the fastener or eyebolt 30 is slidably inserted into the slot 22 in the orientation suggested in FIG. 1. Referring to FIG. 3, the set screw 34 is then turned with an Allen wrench, screwdriver, or other conventional means until its leading end engages the upper lower portion of the fastener or eyebolt 30 to secure it in the device 10. The shank 20 can be inserted into the chuck of a drill and the eyebolt 30 can be installed or removed at the desired location. Thus, the device 10 is very easy to use and operate. The only moving part is the set screw 34. To remove the device 10 from the eyebolt 30, the user merely loosens the set screw 34.

As illustrated by FIG. 1, the device 10 is also quite versatile in that the same device can accommodate several different types of specialized fasteners, such as eyebolts, hooks and the like. Eyebolt 30 is commonly known as an eye screw and has a wood screw end opposite its eye. The eye portion is formed of ½ inch nominal diameter rod. The device 10 makes it possible to install such an eyebolt without predrilling a pilot hole. The device 10 accepts eyebolts having a bolt end opposite the eye, as indicated by the reference numeral 30A in FIG. 1. The device 10 also adapts well to J-shaped hooks as indicated by reference numerals 30B and 30C in FIG. 1.

To accommodate the U-shaped hook 30D an optional cylindrical counterbore 36 is provided in the forward end 16 of the driver head 14. The counterbore 36 is concentric with the axis of rotation 19, has a diameter greater than the width $S_W$ of the slot 22 and a depth $C_D$ less than the slot depth $S_D$. The counterbore 36 receives the nipple at the apex of the inverted U-shaped portion of the hook 30D. The depth $C_D$ is preferably approximately the same as the length of the nipple. Of course, the set screw 34 is not necessary when driving the hook 30D.

A smaller version of the device 10 can be constructed to drive eye screw 30E and eyebolt 30F, which both have eyes formed of ¼ diameter rods. In fact, the examples provided below show preferred nominal dimensions for various features of the device 10 to drive ½ and ¼ specialized fasteners respectively.

EXAMPLE 1

For Eyebolts, Eye Screws or Hooks with ¼–½ Inch Diameter Rods

Head dia.=1 inch
Shank width=⅜ inch
$S_W$=9/16 inch
$S_D$=1 inch
$d_{SS}$=¼ inch
Set screw=¼×20

EXAMPLE 2

For Eyebolts, Eye Screws or Hooks with ⅛–¼ Inch Diameter Rods

Head dia.=1 inch
Shank width=⅜ inch
$S_W$=3/16 inch
$S_D$=1¼ inches
$d_{SS}$=7/32 inch
Set screw=¼×20
Diameter of counterbore=25/64 inch
$C_D$=¼ inch Thus, it can be seen that the present invention at least satisfies its stated objectives.

In the drawings and specifications, there has been set forth a preferred embodiment invention, and although specific terms are employed, these are used in a generic and descriptive sense only and not for purposes of limitation. Changes in the form and proportion of parts as well as in the substitution of equivalents are contemplated as circumstances may suggest or render expedient without departing from the scope of the invention as defined in the following claims.

What is claimed is:

1. A device for driving eyebolts and hooks comprising:

a body including an elongated driver head having opposite forward and rear ends and a central axis of rotation extending through the ends;

the body having a shank connected to the rear end of the driver head for detachably connecting the driver head to a source of rotary power;

the driver head having a centrally located longitudinal slot of a given width therein adapted to slidably receive a nonthreaded portion of an eyebolt or hook, the slot extending across the forward end and along the central axis of rotation toward the rear end to a given depth so as to terminate in a bottom wall and define a pair of opposing side walls, the slot extending completely across the driver head so as to be open on opposite sides;

the driver head having a threaded hole extending through one of the side walls and entering into the slot, the threaded hole having a centerline spaced forwardly a distance $d_{SS}$ from the bottom wall;

a set screw of a given diameter for mating installation into the threaded hole so as to selectively protrude into the slot; and the distance $d_{SS}$ and the diameter of the set screw being such that the set screw engages a rod of an eyebolt or hook placed in the slot with a positive, non-yielding clamping force.

2. The device of claim 1 wherein the means for connecting the body to the source of rotary power is a shank connected to the rear end of the driver head.

3. The device of claim 1 wherein the given depth of the slot is greater than an inside diameter of an eye on the eyebolt to be driven.

4. The device of claim 1 wherein the threaded hole is perpendicular to the axis of rotation.

5. The device of claim 1 wherein the forward end of the driver head has a cylindrical hole formed therein concentric with the axis of rotation, the hole having a diameter greater than the width of the slot and having a depth less than the slot.

* * * * *